US006978895B2

(12) United States Patent
Tumminia

(10) Patent No.: US 6,978,895 B2
(45) Date of Patent: Dec. 27, 2005

(54) TRAY WITH CENTRAL OFFSET SCORE LINES

(75) Inventor: Patricia A. Tumminia, Sheboygan Falls, WI (US)

(73) Assignee: International Paper Company, Stamford, CT (US)

( * ) Notice: Subject to any disclaimer, the term of this patent is extended or adjusted under 35 U.S.C. 154(b) by 0 days.

(21) Appl. No.: 10/632,383

(22) Filed: Aug. 1, 2003

(65) Prior Publication Data

US 2004/0084332 A1 May 6, 2004

Related U.S. Application Data

(60) Provisional application No. 60/401,667, filed on Aug. 7, 2002, provisional application No. 60/400,323, filed on Aug. 2, 2002.

(51) Int. Cl.[7] ..... B65D 1/34; B65D 21/032
(52) U.S. Cl. ..... 206/557; 206/427; 229/174
(58) Field of Search ..... 206/427, 429, 206/432, 557–566; 229/161, 181–183, 930–931, 229/170–174, 104, 120, 120.32, 175–176, 229/190

(56) References Cited

U.S. PATENT DOCUMENTS

| | | | | |
|---|---|---|---|---|
| 1,898,962 | A | 2/1933 | Hvistendahl | |
| 3,062,429 | A | 11/1962 | Liman et al. | |
| 3,076,590 | A | 2/1963 | Curran et al. | |
| 3,474,901 | A * | 10/1969 | Viater | 206/429 |
| 3,841,476 | A * | 10/1974 | Elford | 206/427 |
| 3,927,823 | A | 12/1975 | Persson | |
| 4,437,570 | A | 3/1984 | Sorenson | |
| 5,377,903 | A | 1/1995 | Gordon et al. | |
| 5,624,031 | A * | 4/1997 | Fowler et al. | 206/391 |
| 5,855,334 | A | 1/1999 | Abe et al. | |
| 6,752,311 | B2 * | 6/2004 | Tulkoff | 229/104 |

* cited by examiner

*Primary Examiner*—Bryon P. Gehman
(74) *Attorney, Agent, or Firm*—Daniel C. Stelter

(57) ABSTRACT

The invention provides an open topped tray having upright peripheral side and end walls. The end walls are inwardly positioned by use of an inwardly offset score design which permits the optimization of the dimensions of the tray. This scoring technique may be employed in conventional trays designs at minimal cost for stable housing of bottles or other items.

24 Claims, 5 Drawing Sheets

TRAY WITH CENTRAL OFFSET SCORE LINES

RELATED APPLICATION

This application claims priority from U.S. Provisional Applications Ser. Nos. 60/400,323, filed Aug. 2, 2002 and 60/401,667 filed Aug. 7, 2002.

FIELD OF THE INVENTION

The present invention relates to a corrugated tray, erected from a unitary paperboard blank, for the holding, stacking and transporting of items such as beverage cans and bottles. In particular, the present invention relates to a corrugated tray with inwardly positioned end walls extending upright from centrally located offset score lines in opposing ends of the tray, such that the dimensional space within the tray is optimized, and unwanted shifting of items transported within the tray is minimized.

BACKGROUND OF THE INVENTION

Corrugated paperboard is typically used in many different applications, for example, to form trays, containers, boxes, cartons, or dividers for holding, storing, stacking or shipping various items.

Frequently, corrugated trays are utilized for holding commercial products, such as beverage bottles and cans, to be shipped to stores, kiosks or non-commercial locations for the sale, display or use of the products. Typically, the bottles and cans are shipped in standard shaped trays that tend to have a high length/width to height ratio, that is, the lengths and widths of the bottom panels are significantly larger than the heights of the attached upright side and end walls, resulting in a tray that is ideally suited for carrying one or a multiplicity of items having a short height.

These trays are generally erected from blanks scored with score or cut lines. The blanks are most often scored by automated machines in a continuous in-line process involving cutting, scoring and molding continuous sheets of paperboard. The paperboard is then erected by the automated machine along the score or cut lines to form the tray. Alternatively, the blanks may be erected into a tray by a user or other manual means. The trays may be covered with a removable lid, but are typically used without one.

The side and end walls must be held secure on an upright position when the tray is erected. To achieve this, a standard tray has side flaps foldably attached to opposing edges of the side walls. The side flaps fold inward and adhere to an interior portion of the end walls, thereby connecting and stabilizing the side and end walls into position. Generally, in order to save materials and costs, the side flaps only cover a small portion of the interior of the end wall, for example, a portion that is significantly less than one half the length of the end wall. Thus, when the two opposing side flaps of each opposing side wall are attached to an end wall, a gap is left by the end walls between the two side flaps.

The addition of side flaps that overlap interior portions of the end walls result in a tray wherein the length between the opposing end walls changes depending on the location within the interior space of the tray. Specifically, the tray has a narrower interior space between the end walls where the side flaps overlap the end walls than the space at the center of the tray where no side flaps are present. This results in an uneven space within the tray that causes items such as bottles and cans to shift in transit, namely the row or rows of items located between the end walls in the center of the tray.

The uneven space can potentially be eliminated by attaching the side flaps to an exterior portion of the end wall, thereby having a flat interior within the container. However, this creates an uneven exterior, which can create an unattractive display and has ridges on the outside of the tray that may get caught on other objects, hindering shipment of the goods. Alternatively, the side flaps could be lengthened so that each flap covers about one half of the end wall. Thus, when two opposing side flaps are placed together on the same end wall, the interior gap is eliminated. However, this requires additional raw material and increases production costs.

Therefore, it is an object of this invention to provide a tray that optimizes the space within the tray while maintaining cost and shipping efficiency.

SUMMARY OF THE INVENTION

Accordingly, it is an object of the present invention to provide improvements in a tray design which optimize the tray dimensions for particularly sized items and to stabilize housed items against movement during transport.

It is a further object of the invention to provide such stable arrangements in tray structures without the use of excess paperboard or paperboard inserts and associated costs.

The present invention provides an improved open-topped tray having upright peripheral side and end walls. A central portion of the opposing end walls is inwardly positioned by use of an inwardly offset central portion of the end score line that permits optimization of the tray dimensions at minimal cost.

The tray is formed from a blank having a bottom panel defined by two opposing end score lines and two opposing side score lines, wherein a central portion of each opposing end score line is inwardly offset or positioned. The blank has additional score and cut lines that define opposing end panels, opposing side panels, and side flaps foldably attached to the edges of each of the side panels. The blank is folded and the opposing end and side panels are folded into an upright position, providing the outer walls of the tray. The side flaps fold inward, toward the interior of the tray, and adhere to the interior side of the end panels, holding all upright side and end panels secure. The side flaps line in the same plane as the inwardly offset portions of the end score lines, such that a dimensional space within the interior of the tray is effectively the same between the side flaps on opposing end panels as it is between the inwardly offset central portions of the end score lines at the opposing ends of the tray. Essentially, the inwardly positioned portions of the end score lines move central portions of the end walls inward to fill the gaps between opposing side flaps, equalizing the interior dimensions of the tray.

In other embodiments, the erected trays are of dimensions to accommodate beverage bottles or cans arranged in four rows of six or three rows of four. The outer rows of bottles are flanked on the top and bottom by the side flaps adhered to the end walls. The center row or rows of bottles are flanked by the offset score lines and the inwardly positioned end walls. Thus, all rows of bottles are held secure within the space of the tray regardless of which row they are located in.

Other objects, embodiments, features and advantages of the present invention will be apparent when the description of a preferred embodiment of the invention is considered in conjunction with the annexed drawings, which should be construed in an illustrative and not limiting sense.

BRIEF DESCRIPTION OF THE FIGURES/DRAWINGS

FIG. 1 is a plan view of a paperboard blank for forming an open topped container having inwardly spaced offset score lines.

FIG. 2*a* is a top perspective view of an erected container having end walls inwardly spaced along offset end score lines.

FIG. 2*b* is an enlarged, fragmentary perspective view of the interior of one end of an erected container having end walls inwardly spaced along offset end score lines.

FIG. 2*c* is a bottom perspective view of the exterior of an erected container having end walls inwardly spaced along offset end score lines.

DETAILED DESCRIPTION

Figure 1:
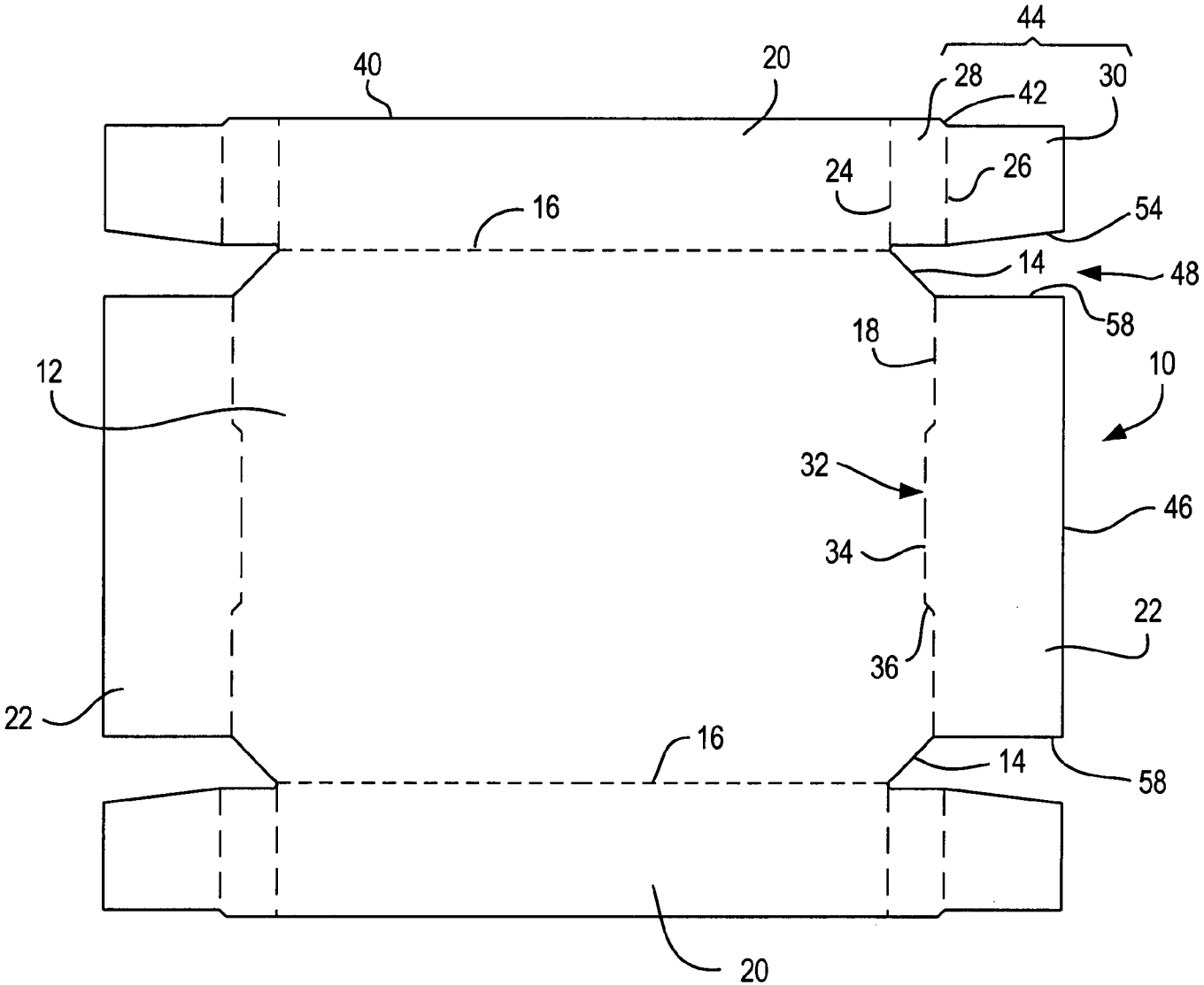

A paper or paperboard tray in accordance with one embodiment of the invention is shown in FIG. 1. Blank 10 is scored for the purpose of folding into an open-topped tray suitable for holding, shipping or stacking a wide variety of objects, such as beverage bottles and cans. The blank is preferably a flat corrugated paper or paperboard made of any material known in the art that is suitable for the shipping and transporting of a particular item. For example, if one were to package heavier materials, a thicker grade may be advisable.

Bottom panel 12 is a substantially rectangular panel bordered by end score lines 18, offset score lines 32 and side score lines 16. End panels 22 foldably connect to bottom panel 12 along end score lines 18 and offset score lines 32, and side panels 20 foldably connect to bottom panel 12 along side score lines 16. The bottom panel may have angled side corners 14 that extend diagonally from the end of score lines 18 to the end of score line 16. The corners create corner cut-outs 48 between the side flaps 44 and the end panels 22. In the present invention, panel 12 has a width of 10½ inches between side score lines, a length of 14⅛ inches between the end score lines 18, and a length of 13¾ inches between inwardly positioned score lines 34. However, the dimensions of the bottom panel can be customized to any particularly shipped item, and thus can vary significantly while maintaining the spirit of the invention. In other embodiments, holes are provided alongside the score lines to provide breathing holes and access for an automated machine to manipulate and fold the blank into a fully erect tray.

Side panels 20 are generally rectangular panels each bordered on four sides by an upper edge 40, lower score line 16, and side score lines 24. Side panels 20 correspond to the side walls when the tray is fully erected. Accordingly, the width of side panels 20 (from score line 16 to outer edge 40) in blank 10 generally corresponds to the height of the side walls of the erected tray in FIGS. 2*a*–2*c*. Ideally, the height of the side panels is the same as the height of end panels 22. In the present example, the width of the side panels is 2⅝ inches, and the height of the erected container is 2 9/15 inches.

Side flaps 44 are foldably connected to side panels 20 along opposing score lines 24. In the present embodiment, each side flap is comprised of two foldably attached sections attached in series. Score lines 24 and 26 define an inner side flap section 28 and an outer side flap section 30. Inner side flap section 28 is generally rectangular in shape and may include angled corner 42. Further, the width of the inner section is slightly less than the width of the side panel 20 to facilitate folding of the side flaps inward, over the bottom panel, without encountering resistance. This slight difference is length can vary, but is preferably about ⅛ of an inch. Outer side flap section 30 generally has a longer length and a shorter width than the inner side flap section. As a result of the shorter width, the height of the outer side flap when the tray is erected is slightly less than the side and end walls of the tray. Outer side flap section 30 may also have a tapered bottom edge 54.

Figure 2A:
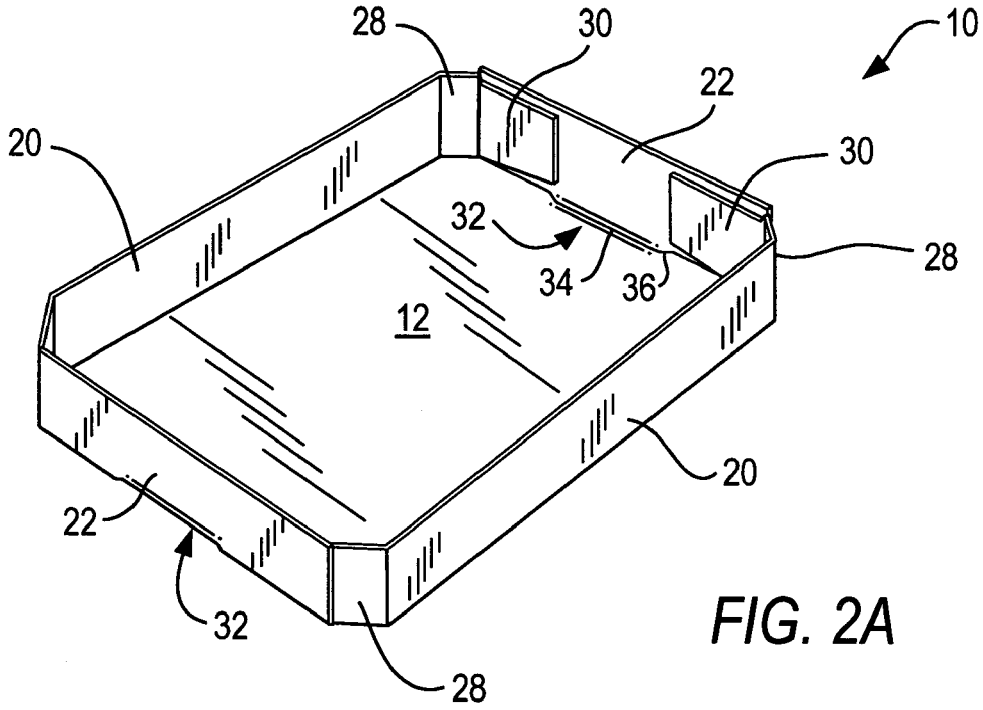
Figure 2B:
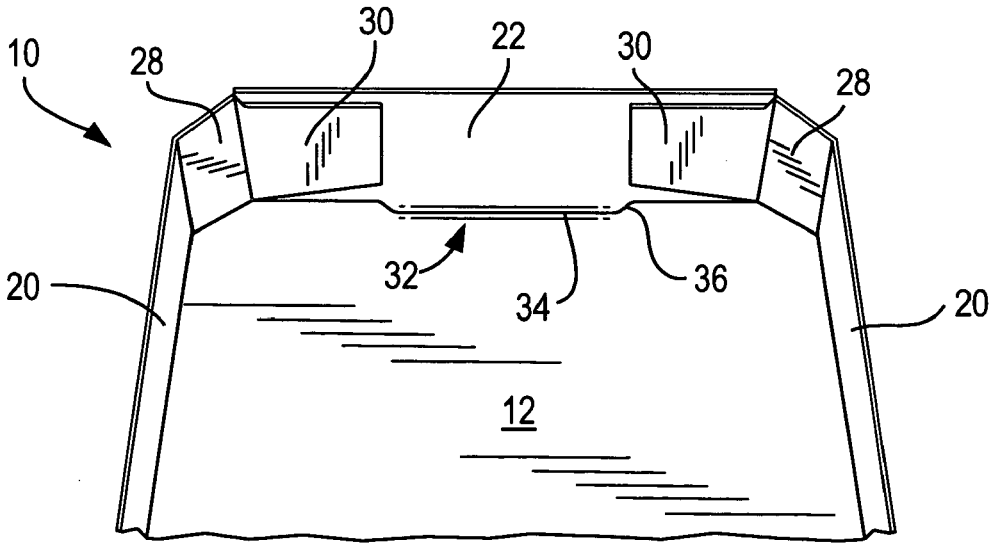
Figure 2C:
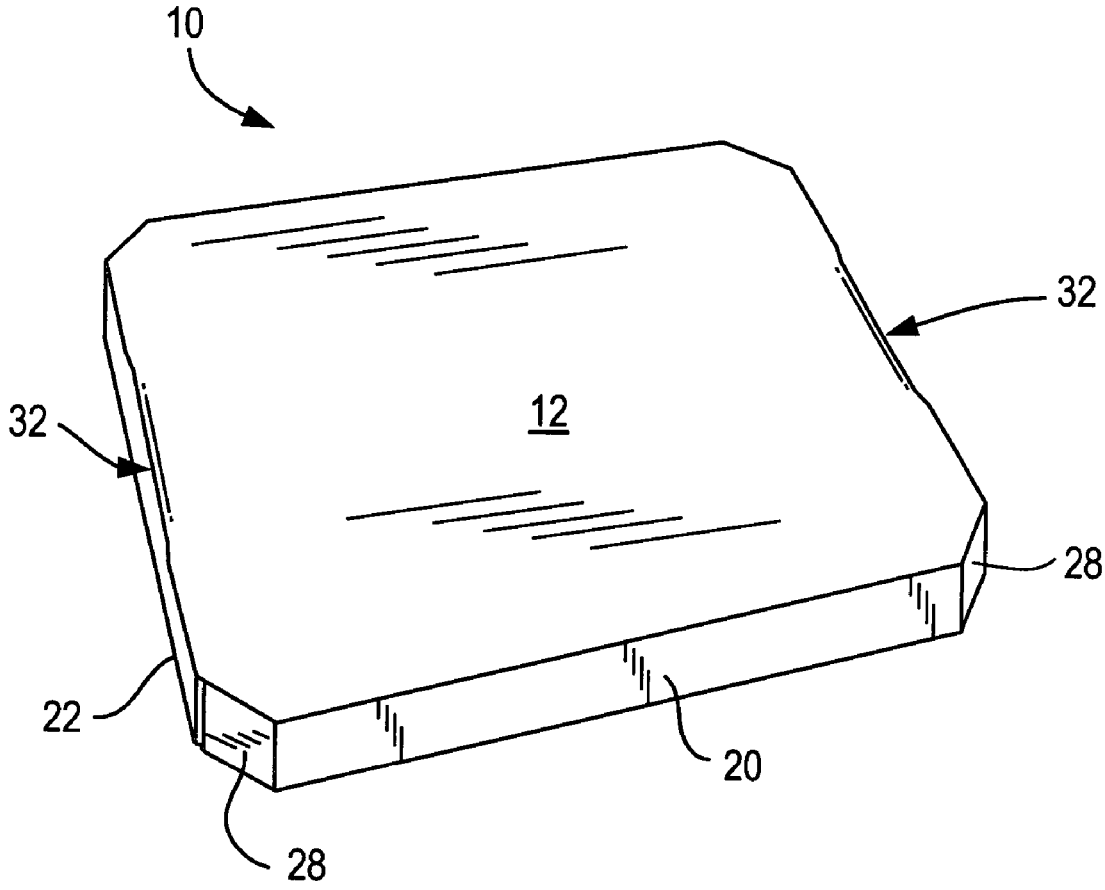

Each opposing end panel 22 is bordered on four sides by an upper edge 46, score line 18, offset score lines 32, which comprise of inwardly positioned scores 34 and 36, and two side edges 48. The end panels 22 are generally rectangular panels that correspond to end walls when the container is fully erected. Accordingly, the width of end panels 22 in blank 10 generally corresponds to the height of the end wall 22 in an erected container, as seen in FIGS. 2*a*–*c*. In the present example, the width of the end panel is 2⅝ inches between the upper edge 46 and score line 18, and 3 inches between the upper edge and score lines 34. However, the width of the panel, and corresponding height of the erected container, can vary widely within the scope of the invention. For example, the height of the erected tray is preferably between 1 and 4 inches. Other features, such as stacking tabs, may extend outwardly from the top edge of the end or side walls.

The score line that foldably connects an end panel 22 with the bottom panel 10 is a generally straight score line 18 with an inwardly offset centrally located score line portion 32. Angled score lines 36 connect score line 18 with the inwardly offset or positioned score line 34. Score line 18 forms a typical bending base line about which the end panel folds upright, such that the base line is the base of the end panel and the outermost side edge of the tray bottom. The inwardly positioned score line 34 is positioned inside the base line, slightly shrinking a central portion of the base panel. Correspondingly, the size of the end panel increases an equivalent area. Thus, the base line is altered where the score line is inwardly positioned, advantageously creating a sculpted score line about which the end panel can fold upright.

In the present embodiment, the spatial difference between base score line 18 and inwardly positioned score line 34 is ⅜ inches. However, as with the other dimensions of the tray, this can vary within the spirit of the invention. In general, however the difference in thickness should be equivalent to the thickness of the paper or paperboard stock, specifically the side flaps. Thus, the offset score lines offset the thickness of the side flaps when the side flaps are adhered to interior portions of the end walls.

The container is erected either manually or by an automated machine. Generally it is done with an automated machine, wherein opposing side panels 20 are simultaneously folded upwards to form side walls 20 along side score lines 16, score lines 24 are folded such that inner side flap section extends upwardly from angled corners 14, and the outer side flaps are folded along score lines 26 just inside score lines 18. Exterior sides of the outer side flap sections should virtually border score lines 18 such that the outer side flap sections generally fill a vertical space that is bordered on two sides by score line 18 and angled score lines 36. It is important that the edges of outer side flap sections 30 do not extend past angled score lines 36.

After the side flaps are folded, the end panels are folded upward along score lines 18 and offset score lines 32, forming end walls 18 as seen in FIGS. 2*a–c*. An exterior side of each outer side flaps section 30 is adhered to an interior portions of the end panel along score line 18, holding the end and side panels secure on an upright formation. Attachment of the side flaps to the end panels may be accomplished using well known hot melt glues, staples, or other fastening techniques, and may be performed by an automated machine or a user.

Due to offset score lines 32, the width of the end panel is greater between upper edge 46 and inwardly positioned score lines 34 and 36 than between edge 46 and score line 18. However, this extra width in the central portion of the end wall is compensated for with a slight inward curve of the central portion of the end wall, resulting in additional distance traveled. Consequently, the height of the end panel along upper edge 46 is the same for the entire end wall, even though the width of the end panel differs from location to location. Further, due to the combination of the offset score lines and the outer side flap portions, the interior of the tray is effectively equidistant from each other across the entire base of the end wall.

One embodiment of the tray as erected is seen in FIG. 2*a*. In this embodiment, the length and width of bottom panel 12 is larger than the height of the side and end walls 20 and 22, resulting in a thin, open-topped tray that is ideally suited for carrying one or a multiplicity of items having a short height. Further, the corners of the containers are angled, creating a non-equilateral octagon interior and exterior best suited for transporting curved items such as cans or bottles. In other embodiments, however, the angles can be accentuated, minimized, or eliminated to best suit a particularly desired type of item. Further, the dimensions of the tray can change dramatically while still maintaining the spirit of the invention, for example, the height of the end and side walls can be increased to hold significantly taller items. Further, it may be preferable to seal tray cartons with shrink wrap for shipment and later storage at warehouses and other retail locations, as the tops of the items held within the tray may extend past the upper edges of the end and side walls.

FIG. 2*b* shows the inwardly positioned offset score line 32 offsetting the thickness of outer side flap sections 30. The offset score line moves a central portion of the end wall inward to compensate for and fill the gap between the opposing side flaps. At least the bottom of the central portion of the end wall extends to a point that is effectively on a same linear plane as the interior (visible) sides of flaps 30. That is to say, the interior dimensions of the tray are effectively equalized even though side flaps are adhered to portions of, but not all of, the end walls. However, as seen in the FIG. 2*b*, the entirety of the central portion of the end wall need not extend to the same position s the interior portion of the side flaps 30. Instead, only a bottom part of the central wall may be fully inwardly positioned. Thus, while the interior ends of the tray are effectively straight, they are not necessarily perfectly straight. Even so, the offset score permits precise dimensioning and support of the bottles in the tray by sufficiently narrowing the tray dimension along the base of the tray to securely bias the central rows of bottles or cans in a stable position.

FIG. 2*c* depicts the exterior side of the tray. Like the interior, the exterior may resemble a non-equilateral octagon. Further, the side flaps do not attach to the exterior sides of the end walls, resulting in a smooth outside end walls without ridges that may disadvantageously catch other trays or items during movement.

Figure 3:
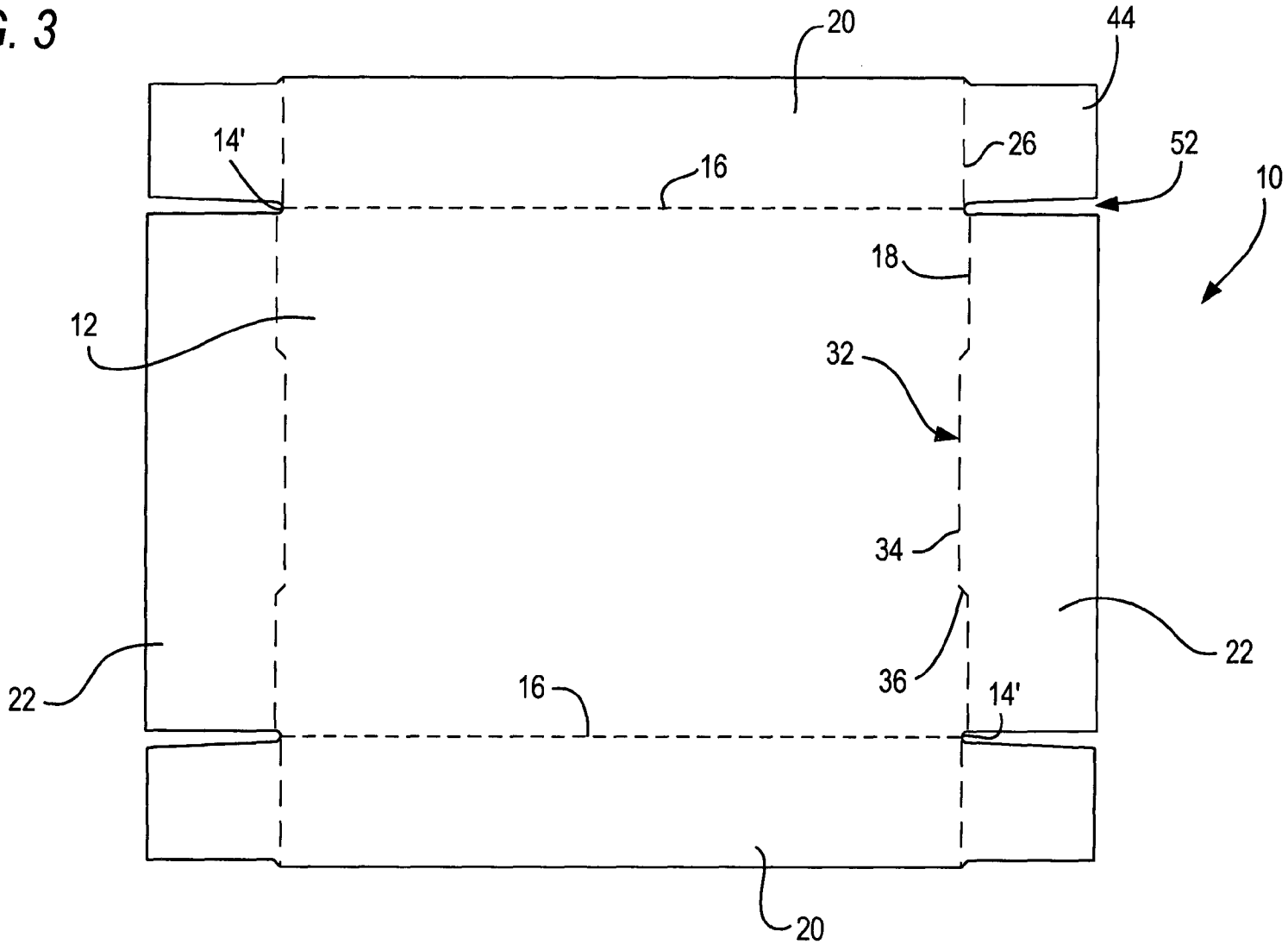
FIG. 3 is a plan view of a paperboard blank having alternate corner cut-outs.

FIG. 3 shows an alternative embodiment wherein the blank and the corresponding tray does not have angled corners. A thin U-shaped corner cut out 52 is provided between the side flaps and the end walls. The side flaps 44 comprise of a single flap. Inner side flap section 28 is unnecessary in this embodiment, as there are no corresponding angled corners. Score line 26 is slightly inwardly positioned from score line 18 to aid effective folding and adherence of the side flap to the end panels. When the tray is erected, the exterior side of the outer side flap section virtually borders the score line 18 such that the flap section fills most of a space that is bordered on two sides by score line 18 and angled score line 36. It is important that the edges of side flap 44 do not extend past score lines 36. In the present embodiment, the length of side flap is 2¾ inches. The distance between score line 16 and the intersection of score lines 18 and 36 is also 2¾ inches. In other embodiments, the length of the side flap can be less than the distance between score lines 16 and 36.

Figure 4:
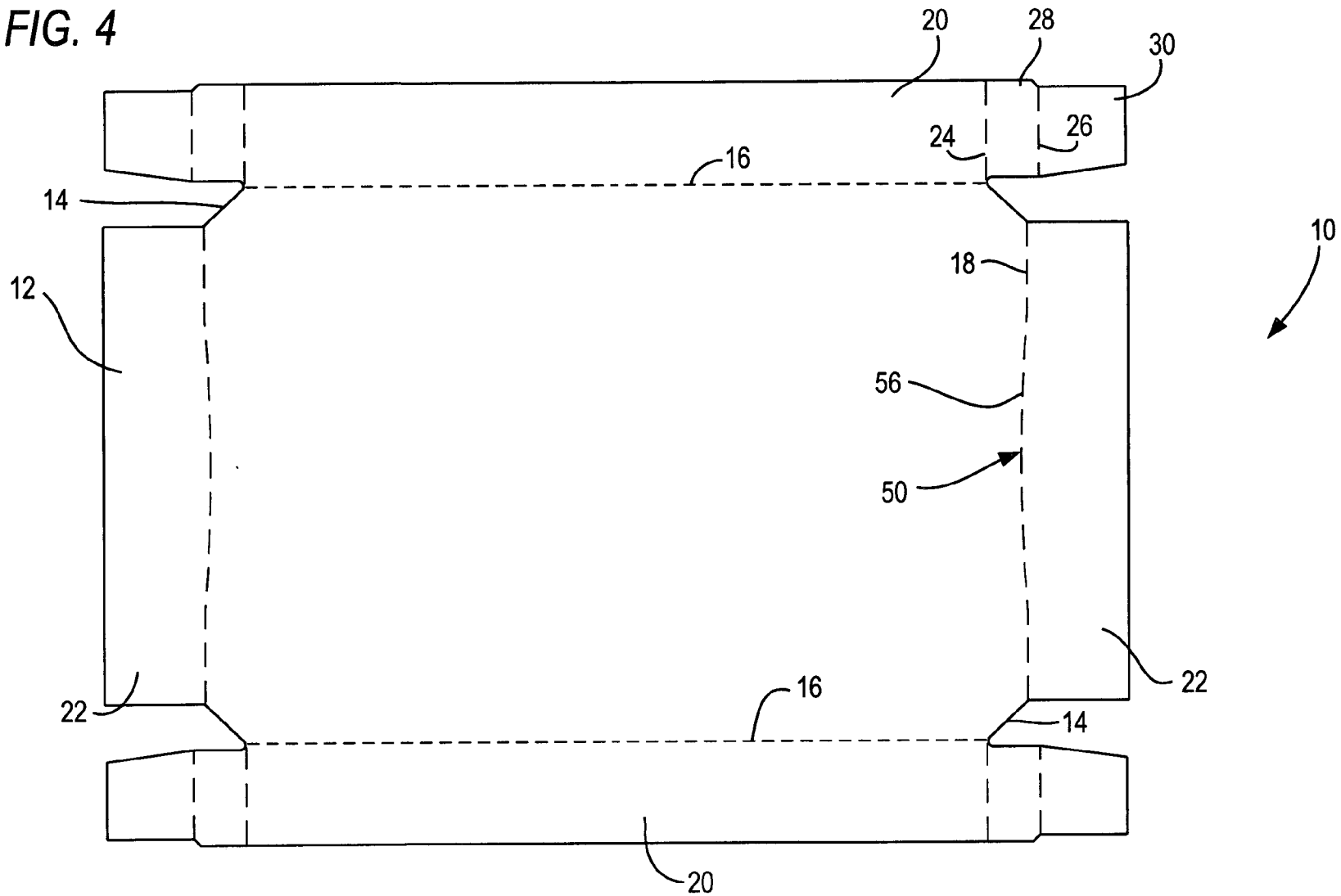
FIG. 4 is a plan view of a paperboard blank having arcuate offset end score lines.

FIG. 4 shows an alternative embodiment wherein an offset score line 56 is arcuate. In this embodiment, a central portion of an end score line slopes inwardly along an arcuate curve toward the center of the tray. At minimum, an innermost point 50 is fully narrowed to a same lateral plane as the interior surface of the outer side flap section 30 when the tray is erected. In the present embodiment, innermost point 50 is inwardly positioned ⅜ inches as compared to score line 18, which accounts for the ⅜ inch thickness of the outer side flap section 30. Thus, the interior dimensions of the tray are equalized by accounting for the thickness of the side flaps to securely bias a central row or rows of items within the tray. The difference between score line 18 and offset score line 56 can be changed if a different thickness of paperboard is used. Other embodiments can include an arcuate score line with different paths, such as those with steeper or lesser slopes. Additional embodiments can include other non-arcuate score lines that fill the gap between opposing side flaps while maintaining the spirit of the invention.

The tray dimensions can vary depending on what types or how many items are being shipped. The preferred dimensions of the interior space within an erected tray is a length between 10 and 18 inches, a width between 7 and 12 inches, and a height between 1 and 4 inches. However, tray dimensions can exceed these preferred limits within the spirit of the invention if the item or items being shipped require the adjustments.

For example, in FIG. 4, the tray dimension have been altered to hold 24 twenty ounce bottles. Bottom panel 12 has a width of 11 11/16 inches between the side score lines, a length of 17 11/16 inches between the end score lines 18, and a length of 17 5/16 inches between the end score lines 34. The height of the side and end walls in the erected tray is 2⅛ inches.

Although the invention has been described with reference to preferred embodiments, it will be appreciated by one of ordinary skill in the art that numerous modifications are possible in light of the above disclosure. For example, the offset score lines can be on the base of the side wall if there are corresponding flaps on the end walls without departing from the spirit of the invention. All such variations and modifications are intended to be within the scope and spirit of the invention as defined in the claims appended hereto.

I claim:

1. In an open-topped container for the shipping and display of food items, wherein the container has a bottom panel, opposing end walls foldably attached to the bottom panel along opposing end score lines, opposing side walls foldably attached to the bottom panel along opposing side score lines, and opposing side flaps foldably attached to each of the opposing side walls along side flap score lines, wherein the side flaps are folded inward along the side flap score lines and attached to an inner portion of a respective one of the opposing end walls, said side flaps at each end of the container being spaced from one another, and said side and end walls and bottom panel defining an interior space having length, width and height dimensions, the improvement comprising an inwardly offset central portion of each said end score line, said inwardly offset central portions being positioned between the spaced apart side flaps at the respective opposing end walls, said inwardly offset portions of the opposing end score lines resulting in the interior length dimension of the container being substantially the same at the central portion of the end walls as it is at the opposite sides of the end walls where the side flaps are attached.

2. The container according to claim 1, wherein the inwardly offset score lines each have angled side portions and a straight or linear central portion, the straight central portion lying in generally the same plane as the side flaps.

3. The container according to claim 1, wherein the inwardly offset score lines are arcuate, wherein an innermost point of each arcuate score line lies in generally the same plane as the side flaps.

4. The container according to claim 1, wherein the opposing side flaps are attached to the opposing end walls with an adhesive.

5. The container according to claim 1, wherein the opposing side flaps are attached to the opposing end walls with staples.

6. The container according to claim 1, wherein the interior length dimension within the container has a length between 10 and 18 inches, the interior width dimension has a width between 7 and 12 inches, and the height dimension has a height between 1 and 3 inches.

7. In a unitary blank having a plurality of intersecting score lines enclosing and defining a base panel, and further defining two opposing end panels foldably connected to the base panel along two opposing end score lines, two opposing side panels foldably connected to the base panel along two opposing side score lines, and two opposing side flaps on opposing sides of the opposing side panels, the improvement comprising inwardly offset central portions of the opposing end score lines, whereby the distance between the central portions of the end score lines at opposing ends of the blank is less than the distance between side portions of the end score lines.

8. The unitary blank according to claim 7, wherein the inwardly offset central portions of the opposing end score lines are straight or linear and have angled side edges connecting them to the side portions of the end score lines.

9. The unitary blank according to claim 7, wherein the inwardly offset central portions of the end score lines are arcuate.

10. The unitary blank according to claim 7, further comprising cut voids in the blank between the end panels and the side panels.

11. The unitary blank of claim 10, wherein the cut voids have angled bottom edges that cut diagonally across the corners of the base panel.

12. The unitary blank of claim 10, wherein the cut voids are narrow, U-shaped cut outs having a bottom point that touches an edge of the base panel.

13. The unitary blank of claim 7, wherein the maximum length of the blank ranges from 20–40 inches, and the maximum width of the blank ranges from 15–35 inches.

14. An open topped container for shipping and display of food items, said container comprising:

a bottom panel;

opposing end walls foldably attached to the bottom panel along opposing end score lines;

opposing side walls foldably attached to the bottom panel along opposing side score lines;

opposing side flaps foldably attached to the opposing side walls along side flap score lines, wherein the side flaps are folded inward along the side flap score lines and adhered to an inner portion of each side of the opposing end walls; and said opposing end score lines have inwardly offset central portions positioned between the side flaps adhered to the inner portions of each side of the opposing end walls.

15. A method for securely shipping a multiplicity of cans or bottles in an open topped corrugated tray, comprising the steps of:

erecting an open topped container having a bottom panel, opposing end walls foldably attached to the bottom panel along opposing end score lines, opposing side walls foldably attached to the bottom panel along opposing side score lines, each of the opposing side walls having opposing side flaps foldably attached to the opposing side walls along side flap score lines, the side flaps adhered to an inner portion of each side of the opposing end walls, and inwardly offset central portions of said end score lines, centrally positioned between the side flaps adhered to the inner portions of each side of the opposing end walls, whereby the distance between the central portions of the opposing end walls is substantially the same as the distance between the side portions of the opposing end walls, and filling the open topped container with the multiplicity of cans or bottles.

16. A method for securely shipping a multiplicity of cans or bottles in an open topped corrugated tray having a bottom panel, opposing side walls, opposing end walls, and opposing side flaps on each side wall adhered to an adjacent inner surface of the end walls, comprising the steps of:

folding opposing side walls upright along opposing side score lines at opposite sides of the bottom panel;

folding the opposing side flaps inwardly along opposing side flap score lines toward the bottom panel and attaching the side flaps to the opposing side walls;

folding a first end wall upright along an end score line having an inwardly offset central portion;

folding a second end wall upright along an end score line having an inwardly offset central portion;

attaching the side flaps to the adjacent inner surface of the first and second end walls in a position flanking the inwardly offset central portion of the end score lines; and filling the open topped container with the multiplicity of cans or bottles.

17. The method according to claim 16, wherein the multiplicity of cans or bottles comprise 24 cans or bottles in six rows of four.

18. The method according to claim 16, wherein the multiplicity of cans or bottles comprise 12 cans or bottles in three rows of four.

19. The method according to claim 16, further comprising the step of shrink wrapping the multiplicity of cans or bottles held in the open topped tray.

20. The method according to claim 16, wherein the inwardly offset central portions of the end score lines each have angled side edges and a straight or linear innermost edge, the linear innermost edge lying in substantially the same plane as the side flaps.

21. The method according to claim 16, wherein the inwardly offset central portions of the end score lines are arcuate, wherein an innermost point of the arcuate score lines lie in substantially the same plane as the side flaps.

22. The method according to claim 16, wherein the opposing side flaps are attached to the first and second end walls with an adhesive.

23. The method according to claim 16, wherein the opposing side flaps are attached to the first and second end walls with staples.

24. The method according to claim 16, wherein the multiplicity of cans or bottles fit within a space within the container having a length between 10 and 18 inches, a width between 7 and 12 inches, and a height between 1 and 4 inches.

* * * * *